US010012461B2

(12) United States Patent
Curry

(10) Patent No.: US 10,012,461 B2
(45) Date of Patent: Jul. 3, 2018

(54) AMBIDEXTROUS CHARGING HANDLE

(71) Applicant: Smith & Wesson Corp., Springfield, MA (US)

(72) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 307 days.

(21) Appl. No.: 14/728,525

(22) Filed: Jun. 2, 2015

(65) Prior Publication Data

US 2016/0356564 A1 Dec. 8, 2016

(51) Int. Cl.
*F41A 3/72* (2006.01)

(52) U.S. Cl.
CPC ..... *F41A 3/72* (2013.01)

(58) Field of Classification Search
CPC .... F41A 19/34; F41A 3/72; F41A 3/12; F41A 3/06; F41A 19/24
USPC ..... 42/16; 89/1.4
See application file for complete search history.

(56) References Cited

U.S. PATENT DOCUMENTS 1,858,498 A * 5/1932 Hatcher ..... F41A 7/02 89/1.4
2,030,149 A * 2/1936 Mossberg ..... F41A 3/22 42/16
2,353,283 A * 7/1944 Woodhull ..... F41A 3/72 42/111
2,418,906 A * 4/1947 Sampson ..... F41A 3/82 42/16
2,845,001 A * 7/1958 Hillberg ..... F41A 7/02 89/1.4
3,225,653 A * 12/1965 Packard ..... F41A 3/72 42/16
3,377,730 A * 4/1968 Lewis ..... F41A 3/18 42/16
5,214,233 A * 5/1993 Weldle ..... F41A 3/72 89/1.4
6,311,603 B1 * 11/2001 Dunlap ..... F41A 3/72 42/2
7,231,861 B1 * 6/2007 Gauny ..... F41A 3/72 42/16
7,240,600 B1 * 7/2007 Bordson ..... F41A 3/72 42/69.01
7,707,921 B1 * 5/2010 Hoel ..... F41A 35/06 42/16
7,832,322 B1 * 11/2010 Hoel ..... F41A 35/06 42/16
8,104,393 B2 * 1/2012 Kincel ..... F41A 3/72 42/16
8,266,998 B1 * 9/2012 Davis ..... F41A 35/06 42/71.01

(Continued)

*Primary Examiner* — Troy Chambers
*Assistant Examiner* — Bridget A Cochran
(74) *Attorney, Agent, or Firm* — John A. Chionchio, Esquire; Ballard Spahr LLP

(57) ABSTRACT

A charging handle for a rifle has a grip that is pivotable and slidable on a base connected to a bolt carrier through a rod. A latch mounted on the base engages the receiver of the rifle. The latch is pivotable on the base to release the charging handle from the receiver when cocking the bolt carrier. Pivoting of the latch is effected through a cam attached to the grip. The cam contacts a cam follower on the latch. Both pivoting and sliding motion of the grip relative to the base pivot the latch to effect release of the charging handle from the receiver.

38 Claims, 6 Drawing Sheets

(56) References Cited

U.S. PATENT DOCUMENTS 8,356,537 B2 * 1/2013 Kincel ..... F41A 3/72 42/16
8,567,301 B1 * 10/2013 Sharron ..... F41A 35/06 89/1.4
D705,383 S * 5/2014 Montes ..... D22/108
8,863,632 B1 * 10/2014 O'Malley ..... F41A 3/72 42/16
D726,860 S * 4/2015 Underwood ..... D22/108
D738,452 S * 9/2015 Underwood ..... D22/108
D749,687 S * 2/2016 Warensford ..... D22/108
9,354,004 B2 * 5/2016 Brubaker ..... F41A 35/06
9,366,489 B1 * 6/2016 Strom ..... F41A 35/06
9,389,032 B2 * 7/2016 Daley, Jr. ..... F41A 3/66
D772,369 S * 11/2016 Geissele ..... D22/108
9,500,421 B1 * 11/2016 Geissele ..... F41A 3/72
9,541,339 B2 * 1/2017 Orne, III ..... F41A 3/72
D781,988 S * 3/2017 Geissele ..... D22/108
9,587,896 B1 * 3/2017 Huang ..... F41A 3/72
2010/0000396 A1 * 1/2010 Brown ..... F41A 3/72 89/1.4
2011/0174139 A1 * 7/2011 Olsen ..... F41A 3/72 89/1.4
2011/0214558 A1 * 9/2011 Kincel ..... F41A 9/00 89/1.4
2011/0226120 A1 * 9/2011 Fitzpatrick ..... F41A 19/47 89/1.4
2012/0291612 A1 * 11/2012 Kincel ..... F41A 3/72 89/1.4
2013/0061737 A1 * 3/2013 Brown ..... F41A 3/72 89/1.4
2013/0092014 A1 * 4/2013 Kincel ..... F41A 3/72 89/1.4
2013/0174457 A1 * 7/2013 Gangl ..... F41A 3/18 42/16
2013/0192113 A1 * 8/2013 Melville ..... F41A 3/72 89/1.4
2014/0060293 A1 * 3/2014 Gomez ..... F41A 3/72 89/1.4
2014/0060294 A1 * 3/2014 Brown ..... F41A 5/24 89/1.4
2014/0345444 A1 * 11/2014 Hillman ..... G01N 15/06 89/1.4
2015/0233657 A1 * 8/2015 Barker ..... F41A 3/72 89/1.4
2015/0308762 A1 * 10/2015 McGinty ..... F41A 35/06 89/1.4
2015/0316335 A1 * 11/2015 Withey ..... F41A 3/22 42/16
2016/0061542 A1 * 3/2016 Daley, Jr. ..... F41A 3/72 89/1.4
2016/0102930 A1 * 4/2016 Miller ..... F41A 3/72 89/1.4
2016/0178298 A1 * 6/2016 Daniel ..... F41A 3/72 89/1.4

* cited by examiner

AMBIDEXTROUS CHARGING HANDLE

FIELD OF THE INVENTION

This invention concerns charging handles for modern sporting rifles.

BACKGROUND

In an effort to improve the reliability and ease of use of modern sporting rifles it is advantageous to accommodate both left handed and right handed shooters. To this end, rifle designs have been implemented which emphasize ambidextrous features. The charging handle is a natural candidate for such consideration. The charging handle is central to the operation of the modern sporting rifle, as its action draws the bolt carrier out of battery, cocks the hammer, and, upon release, allows the bolt carrier to run back into battery, stripping a round from the magazine and chambering the round. The charging handle should also be reliably attached to the receiver once the rifle is charged and during firing, but must also release readily from the receiver to permit charging or release of the bolt carrier when a new magazine is inserted.

It is desirable that the charging handle be robust and reliable, which is achieved by a simple design with few moving parts. A review of the known prior art indicates that there is clearly a need for improvements in charging handles for modern sporting rifles.

SUMMARY

The invention concerns a charging handle for moving a bolt carrier of a firearm. In one example embodiment the charging handle comprises a base and a latch movably mounted on the base. The latch has a contact surface movable into and out of engagement with the firearm upon motion of the latch. A cam follower mounted is on the latch and a link is movably mounted on the base. A cam is mounted on the link and engages the cam follower. A grip is attached to the link. Manual pulling of the grip moves the cam, the cam follower follows the cam thereby moving the latch contact surface out of engagement with the firearm.

In a specific example embodiment, the latch is pivotably mounted on the base about a pivot axis. Further by way of example, the cam follower comprises a lobe extending from the latch. In this example, the pivot axis passes through the lobe. In another example embodiment the charging handle further comprises a plunger movably mounted on the base. The plunger engages the latch in this example. A spring acts between the base and the plunger. The spring biases the plunger toward the latch for biasing the latch contact surface into engagement with the firearm.

An example charging handle further comprises a spring acting between the base and the link for biasing the cam away from the cam follower. In another example the link comprises a shaft having a first end engaged with the grip. A pin extends from the shaft proximate to the second end. The cam is mounted on the pin in this example.

By way of example, the grip comprises a first projection positioned on a first side of the link, and a second projection positioned on a second side of the link opposite to the first side. In an example embodiment the grip is pivotably mounted on the link. Again by way of example, the grip further comprises a first reaction surface positioned on the base and a first pivot surface positioned on the first projection and facing the first reaction surface. The first pivot surface engages the first reaction surface when the second projection is pulled to pivot the grip.

In an example embodiment at least one of the first pivot surface and the first reaction surface is curved. In another example, the grip further comprises a second reaction surface positioned on the base and a second pivot surface positioned on the second projection and facing the second reaction surface. The second pivot surface engages the second reaction surface when the first projection is pulled to pivot the grip.

In an example embodiment, at least one of the second pivot surface and the second reaction surface is curved. An example embodiment of the charging handle further comprises a rod having a first end attached to the base and a second end engageable with the bolt carrier.

The invention also includes another example charging handle for moving a bolt carrier of a firearm. In this example the charging handle comprises a base and a latch pivotably mounted on the base about a pivot axis. The latch has a contact surface movable into and out of engagement with the firearm upon pivoting of the latch. A plunger is movably mounted on the base in this example. The plunger engages the latch. A spring acts between the base and the plunger. The spring biases the plunger toward the latch for biasing the latch contact surface into engagement with the firearm. A cam follower is mounted on the latch. A link is slidably mounted on the base. A cam is mounted on the link and engages the cam follower. A grip is attached to the link. Manual pulling of the grip moves the cam, the cam follower follows the cam and thereby moves the latch contact surface out of engagement with the firearm.

In a particular example embodiment the cam follower comprises a lobe extending from the latch. By way of example, the pivot axis passes through the lobe.

In another example embodiment, the link comprises a shaft having a first end engaged with the grip and a second end. A pin extends from the shaft proximate to the second end. The cam is mounted on the pin in this example embodiment.

By way of example, the grip comprises a first projection positioned on a first side of the link, and a second projection positioned on a second side of the link opposite to the first side. In a further example the grip is pivotably mounted on the link.

In an example embodiment the grip comprises a first reaction surface positioned on the base and a first pivot surface positioned on the first projection and facing the first reaction surface. The first pivot surface engages the first reaction surface when the second projection is pulled to pivot the grip.

In a particular example embodiment at least one of the first pivot surface and the first reaction surface is curved. By way of further example, the grip comprises a second reaction surface positioned on the base and a second pivot surface positioned on the second projection and facing the second reaction surface. The second pivot surface engages the second reaction surface when the first projection is pulled to pivot the grip in this embodiment. In another example, at least one of the second pivot surface and the second reaction surface is curved.

In an example embodiment, the charging handle further comprises a rod having a first end attached to the base and a second end engageable with the bolt carrier.

The invention further encompasses a firearm. In a particular example embodiment the firearm comprises a bolt carrier and a rod having a first end engageable with the bolt carrier and a second end. The example firearm further includes a charging handle comprising a base attached to the second end of the rod. A latch is movably mounted on the base. The latch has a contact surface movable into and out of engagement with the firearm upon motion of the latch. A cam follower is mounted on the latch. A link is movably mounted on the base. A cam is mounted on the link and engages the cam follower. A spring acts between the base and the link for biasing the cam away from the cam follower. A grip is attached to the link. In this example firearm manual pulling of the grip moves the cam, the cam follower follows the cam and thereby moves the latch contact surface out of engagement with the firearm.

In an example firearm embodiment, the latch is pivotably mounted on the base about a pivot axis. The cam follower comprises a lobe extending from the latch. The pivot axis passes through the lobe in a particular example embodiment.

By way of example, the firearm further comprises a plunger movably mounted on the base. The plunger engages the latch and a spring acts between the base and the plunger. The spring biases the plunger toward the latch for biasing the latch contact surface into engagement with the firearm.

In an example embodiment a spring acts between the base and the link for biasing the cam away from the cam follower. By way of example the link comprises a shaft having a first end engaged with the grip and a second end. A pin extends from the shaft proximate the second end. The cam is mounted on the pin in this example.

In an example embodiment the grip comprises a first projection positioned on a first side of the link, and a second projection positioned on a second side of the link opposite to the first side. By way of example, the grip is pivotably mounted on the link.

In a specific example embodiment the grip further comprise a first reaction surface positioned on the base and a first pivot surface positioned on the first projection and facing the first reaction surface. The first pivot surface engages the first reaction surface when the second projection is pulled to pivot the grip.

In a specific example embodiment, at least one of the first pivot surface and the first reaction surface is curved.

By way of example, the grip further comprises a second reaction surface positioned on the base and a second pivot surface positioned on the second projection and facing the second reaction surface. The second pivot surface engages the second reaction surface when the first projection is pulled to pivot the grip. In a particular example embodiment, at least one of the second pivot surface and the second reaction surface is curved.

DETAILED DESCRIPTION

Figure 1:
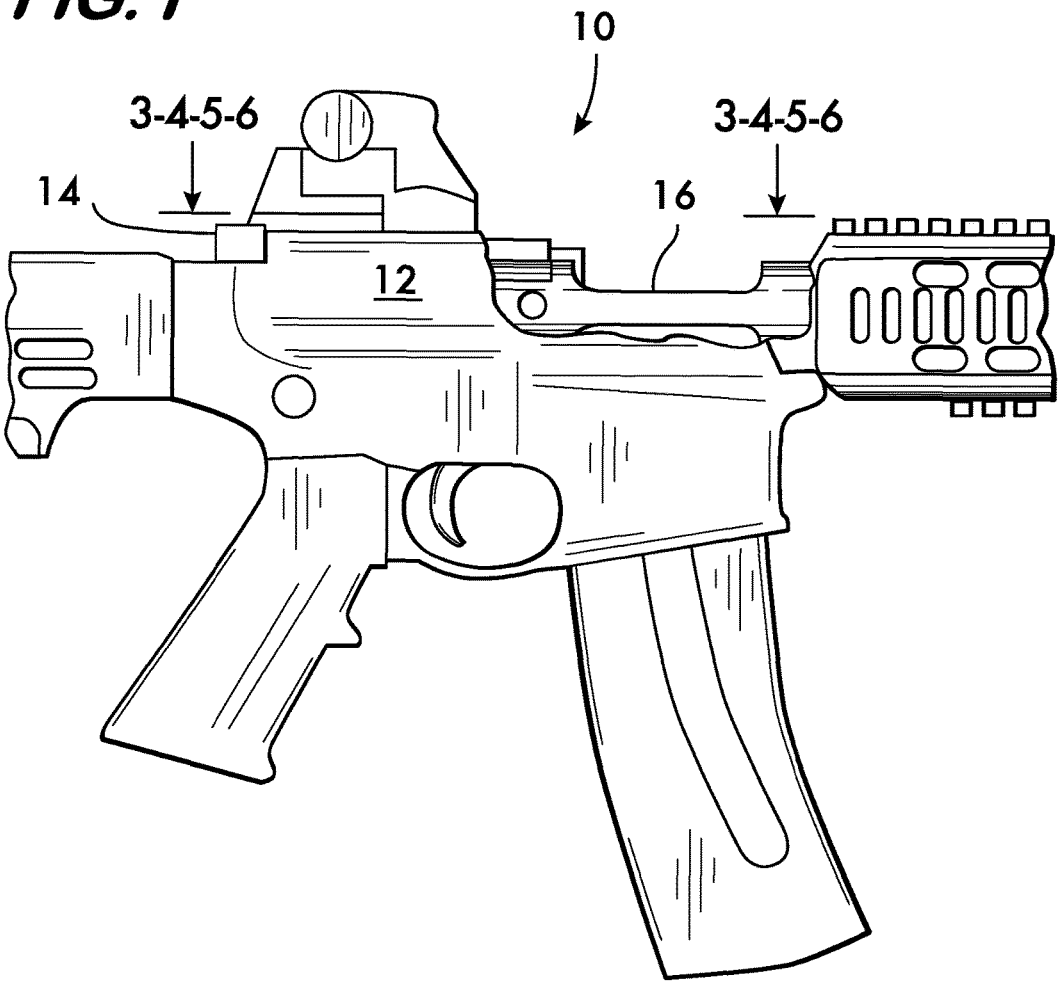
FIG. 1 is a partial view of a firearm having an example charging handle according to the invention.
Figure 2:
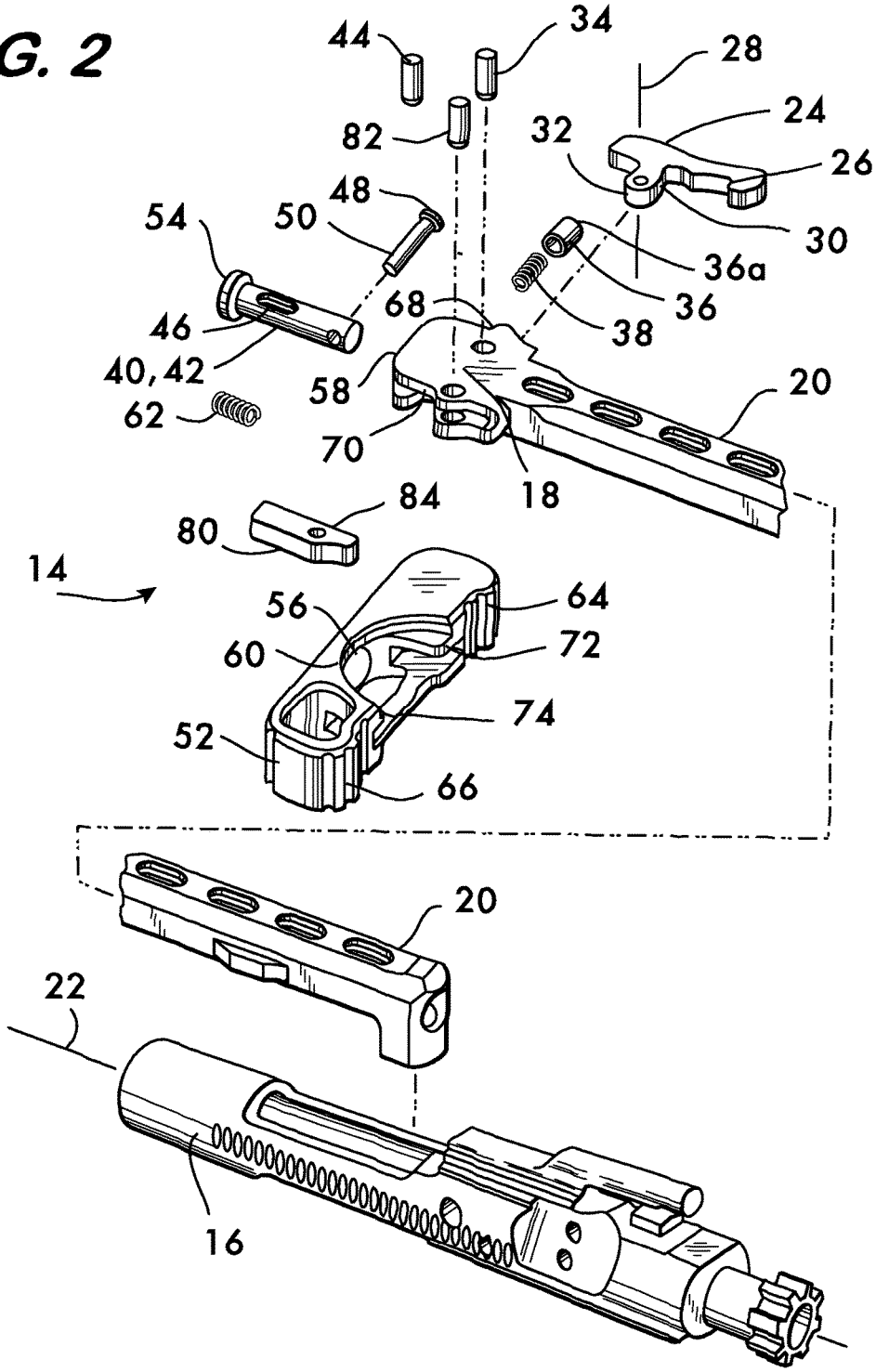
FIG. 2 is an exploded isometric view of an example charging handle according to the invention.
Figure 3:
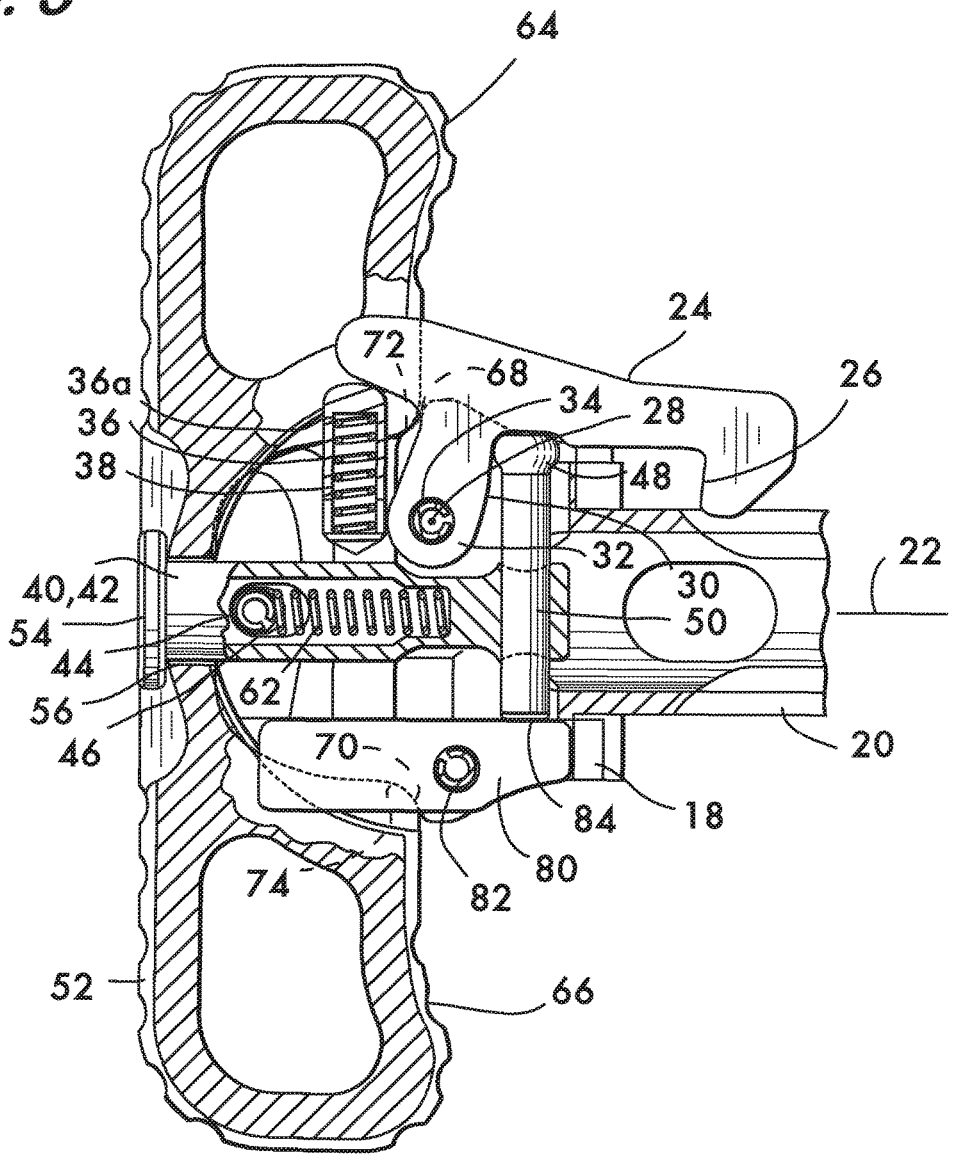
FIGS. 3-6 are partial sectional plan views of the example charging handle taken at lines 3-4-5-6 of FIG. 1.

FIG. 1 shows an example modern sporting rifle 10 having a receiver 12. A charging handle 14 is mounted on receiver 12 along with a bolt carrier 16. FIG. 2 shows an exploded view of an example charging handle 14 according to the invention, and FIG. 3 shows the charging handle 14 in an assembled state. With reference to FIGS. 2 and 3, example charging handle 14 comprises a base 18 attached to one end of a rod 20. The other end of rod 20 engages the bolt carrier 16, permitting the charging handle to cock the bolt when it is drawn along the longitudinal axis 22 of the bolt carrier. A latch 24 is movably mounted on the base 18. Latch 24 comprises a contact surface 26 that is movable into contact with a notch or other surface (not shown) on the receiver 12 to lock the charging handle to the receiver. The contact surface 26 is movable out of contact with the receiver 12 when it is desired to cock the bolt and charge the rife for firing. In this example the latch 24 is pivotably mounted on the base 18, wherein motion about a pivot axis 28 permits engagement and disengagement of the contact surface 26 with the receiver 12.

As shown in FIGS. 2 and 3, a cam follower 30 is mounted on the latch 24, the cam follower in this example comprising a lobe 32 extending from the latch 24. The pivot axis 28 of the latch 24 passes through the lobe, and pivoting motion of the latch is permitted by a pivot pin 34 that passes through the lobe 32 and secures the latch to base 18. A plunger 36 is mounted on the base 18, the plunger having an end **36*a* engageable with the latch 24. A plunger spring 38 acts between the base 18 and plunger 38 to bias the contact surface 26 into contact with the receiver 12**.

A link 40 is movably mounted on the base 18. As shown in FIG. 3, link 40 in this example comprises a shaft 42 fixed to the base by a shaft retaining pin 44. The shaft is slidably movable parallel to axis 22 relatively to the base 18, with sliding motion of the shaft 42 relative to base 18 being permitted through engagement of the shaft retaining pin 44 in a slotted hole 46 extending transversely through the shaft 42. A cam 48 is mounted on the link 40. In this example the cam 48 is mounted on a cam pin 50 that extends transversely from the shaft 42, the cam pin 50 being located proximate one end of the shaft.

A grip 52 is attached to the link 40, in this example to the end of shaft 42 opposite to the cam pin 50. Grip 52 is retained to the shaft 42 by an enlarged head 54 on the shaft. The shaft 42 passes through an opening 56 in the grip that is larger than the shaft, but not the head. This allows for free play between the grip 52 and the shaft 42, permitting the grip to pivot relatively to the shaft and the base 18 as explained below. Relative rotation of the grip 52 to the base 18 is facilitated by the interfacing of a convex surface 58 of the base 18 with a concave surface 60 on the grip 52 (see FIG. 2). As shown in FIG. 3, a shaft spring 62 is positioned within the shaft 42 and engages the fixed shaft retaining pin 44 to bias the shaft 42 and the grip 52 toward the rod 20 relative to the base 18. Shaft spring 62 also has the effect of biasing the cam 48 away from the cam follower 30. The grip 52 comprises first and second projections 64 and 66 that extend respectively on first and second opposite sides of the link 40 (shaft 42). The projections 64 and 66 provide purchase for manual operation of the charging handle 14.

Figure 4:
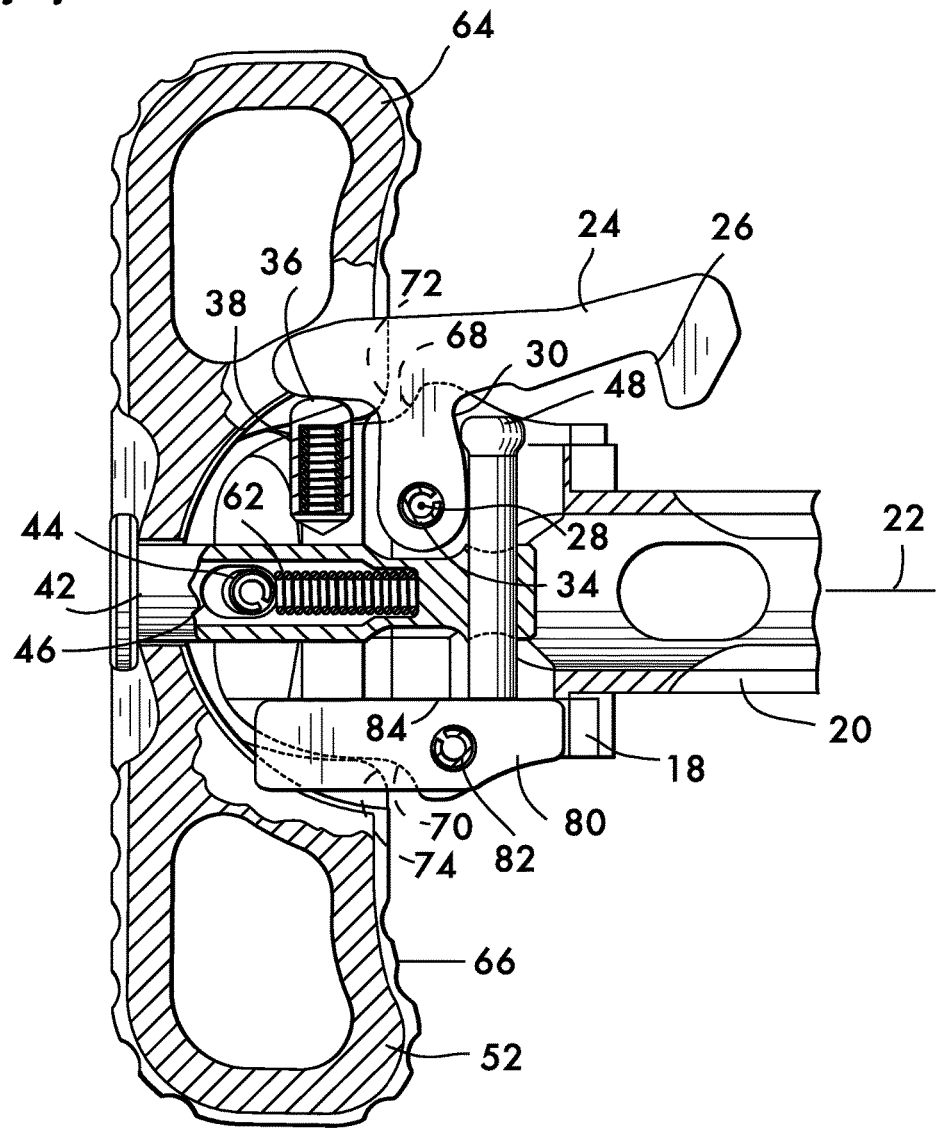

Operation of the example charging handle 14 is described with reference to FIGS. 4-6. As shown in FIG. 4, a straight pull of the grip 52 along axis 22 (i.e., a pull that does not cause the grip to pivot relatively to the base 18) initially pivots and disengages the latch 24 from the receiver 12, and continued pulling draws the bolt carrier out of battery to cock and charge the rifle 10. The effect of a straight back pull of both projections 64 and 66 in the direction along axis 22 is shown by a comparison of FIGS. 3 and 4. Note that the straight pull is effective when there is tension on the rod 20, i.e., when the bolt carrier 16 is in battery and the rod 20 is engaged with it. The pull on grip 52 initially moves the shaft 42 relatively to the base 18. Motion of the shaft 42 relative to the base 18 is limited to the lost motion provided by the slotted hole 46 in shaft 42, the motion compressing the shaft spring 62 against the shaft retaining pin 44. Motion of shaft 42 also moves the cam 48 toward the cam follower 30. Interaction between the cam 48 and the cam follower 30 causes the latch 24 to pivot about its pivot axis 28 (defined by pivot pin 34) compressing the plunger spring 38 via the plunger 36 and thereby disengaging the latch contact surface 26 from the receiver 12. Disengagement of the latch 24 from the receiver 12 permits the charging handle to be drawn further along the direction of axis 22, thereby moving the bolt carrier 16 out of battery to cock the rifle 10. Release of the grip 52 permits the bolt carrier 16 to run back into battery under its return spring (not shown), stripping a round from the magazine and chambering the round. The charging handle 14 follows the bolt carrier 16, and the shaft spring 62 biases the cam 48 away from the cam follower 30 and thereby permits the plunger spring 38, working through plunger 36, to pivot the latch 24 so that it engages and locks the charging handle 24 to the receiver 12 as the bolt carrier 16 moves into battery.

Figure 5:
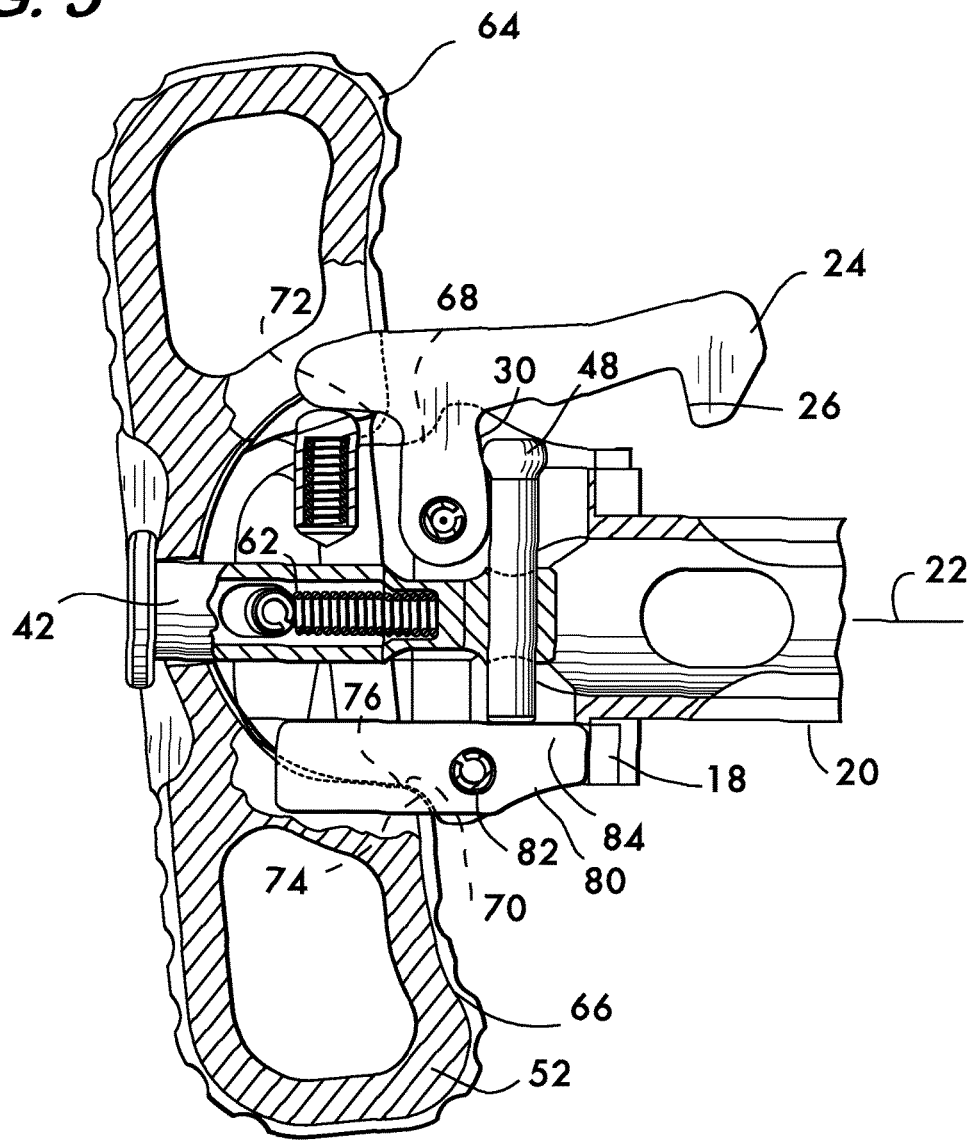
Figure 6:
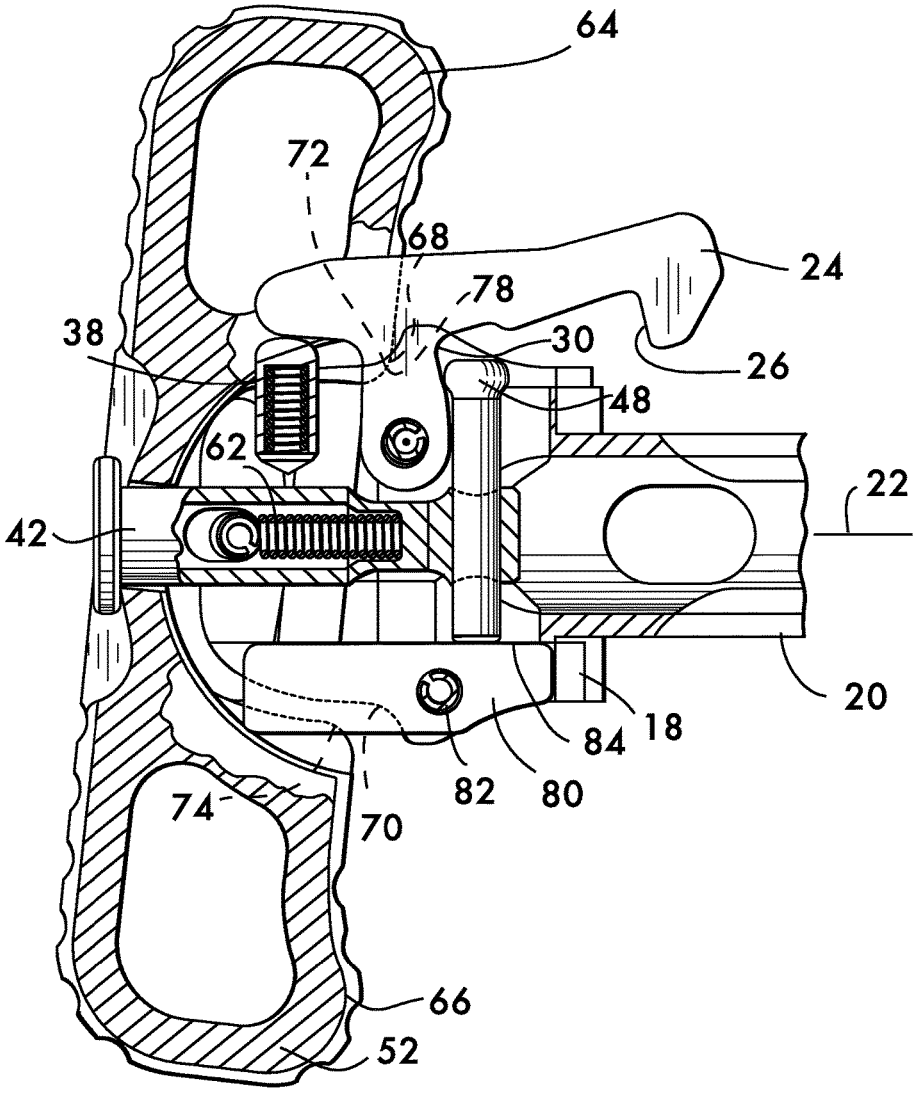

As shown in FIGS. 5 and 6, pivoting motion of the grip 52 relative to the base 18 is advantageous because it allows the grip to release the latch 24 from the receiver 12 when there is no tension on the rod 20. This condition occurs when the bolt carrier 16 is locked in the open position (i.e., out of battery) after the last round has been fired from the magazine. To charge the rifle after insertion of a new magazine, the charging handle 14 is pulled until it engages the bolt carrier 16 and draws it so that it disengages from the bolt catch (not shown). Releasing the charging handle 14 at this time permits the bolt carrier to move into battery under the force of its return spring (not shown), stripping and chambering the next round. If there is no tension on the rod 20, a straight pull back on the grip 52 (FIG. 4) will not release the latch 24 from receiver 12. However, pivoting of the latch 24 relative to the shaft 42 and base 18, as illustrated in FIGS. 5 and 6, will displace the shaft 42 and move the cam 48 against the cam follower 30, which pivots the latch 24 and disengages the contact surface 26 from the receiver 12. Displacement of the shaft 42 is effected when the grip 52 pivots and engages one of two reaction surfaces 68 and 70 positioned on the base 18. The reaction surfaces 68 and 70 are positioned on opposite sides of the base adjacent to respective projections 64 and 66 of the grip 52. The reaction surfaces 68 and 70 may be curved as shown and engage facing pivot surfaces 72 and 74 respectively positioned on projections 64 and 66. For smooth operation the pivot surfaces 72 and 74 may also be curved as shown. When a torque is applied to the grip 52, for example, by pulling only on projection 64 as shown in FIG. 5, the grip pivots on shaft 42 and the pivot surface 74 on the projection 66 engages its corresponding reaction surface 70 on the base 18. The grip then pivots about a new pivot center 76 located between pivot surface 74 and reaction surface 70 and draws the shaft 42 against its shaft spring 62, forcing the cam 48 against the cam follower 30 to release the latch 24. Similarly, as shown in FIG. 6, when a torque is applied to the grip 52 by pulling only on projection 66, the grip pivots on shaft 42 and the pivot surface 72 on the projection 64 engages its corresponding reaction surface 68 on the base 18. The grip then pivots about a new pivot center 78 located between pivot surface 72 and reaction surface 68 and draws the shaft 42 against its shaft spring 62, forcing the cam 48 against the cam follower 30 to release the latch 24. Curved pivot surfaces 72 and 74 engaging curved reaction surfaces 68 and 70 facilitate the pivoting motion of the grip 52.

A guide body 80 is mounted on base 18 adjacent to the shaft 42. Guide body 80 is pivotably mounted to base 18 via pin 82 in this example, and presents a guide surface 84 that faces and engages an end of cam pin 50 opposite the cam 48. Guide surface 84 helps keep the cam 48 engaged with the cam follower 30 on lobe 32 of the latch 24 when shaft 42 moves relatively to the base 18 when the grip 52 pivots.

Charging handles according to the invention are expected to be robust and reliable while providing the advantage of ambidextrous operation to the modern sporting rifle.

What is claimed is:

1. A charging handle for moving a bolt carrier of a firearm, said charging handle comprising:

a base;

a latch movably mounted on said base, said latch having a contact surface movable into and out of engagement with said firearm upon motion of said latch;

a cam follower mounted on said latch;

a link movably mounted directly on said base;

a cam mounted on said link and engaging said cam follower;

a grip attached to said link;

a guide body mounted directly on said base in spaced relation to said link, said cam engaging said guide body upon motion of said latch for maintaining said cam engaged with said cam follower; wherein manual pulling of said grip moves said cam, said cam follower following said cam thereby moving said latch contact surface out of engagement with said firearm.

2. The charging handle according to claim 1, wherein said latch is pivotably mounted on said base about a pivot axis.

3. The charging handle according to claim 2, wherein said cam follower comprises a lobe extending from said latch.

4. The charging handle according to claim 3, wherein said pivot axis passes through said lobe.

5. The charging handle according to claim 1, further comprising:

a plunger movably mounted on said base, said plunger engaging said latch;

a spring acting between said base and said plunger, said spring biasing said plunger toward said latch for biasing said latch contact surface into engagement with said firearm.

6. The charging handle according to claim 1, further comprising a spring acting between said base and said link for biasing said cam away from said cam follower.

7. The charging handle according to claim 1, wherein:

said link comprises a shaft having a first end engaged with said grip and a second end;

a pin extends from said shaft proximate said second end thereof, said cam being mounted on said pin.

8. The charging handle according to claim 1, wherein said grip comprises a first projection positioned on a first side of said link, and a second projection positioned on a second side of said link opposite to said first side.

9. The charging handle according to claim 8, wherein said grip is pivotably mounted on said link.

10. The charging handle according to claim 9, wherein said grip further comprises:

a first reaction surface positioned on said base;

a first pivot surface positioned on said first projection and facing said first reaction surface, said first pivot surface engaging said first reaction surface when said second projection is pulled to pivot said grip.

11. The charging handle according to claim 10, wherein at least one of said first pivot surface and said first reaction surface is curved.

12. The charging handle according to claim 10, wherein said grip further comprises:

a second reaction surface positioned on said base;

a second pivot surface positioned on said second projection and facing said second reaction surface, said second pivot surface engaging said second reaction surface when said first projection is pulled to pivot said grip.

13. The charging handle according to claim 12, wherein at least one of said second pivot surface and said second reaction surface is curved.

14. The charging handle according to claim 1, further comprising a rod having a first end attached to said base and a second end engageable with said bolt carrier.

15. A charging handle for moving a bolt carrier of a firearm, said charging handle comprising:

a base;

a latch pivotably mounted on said base about a pivot axis, said latch having a contact surface movable into and out of engagement with said firearm upon pivoting of said latch;

a plunger movably mounted on said base, said plunger engaging said latch;

a spring acting between said base and said plunger, said spring biasing said plunger toward said latch for biasing said latch contact surface into engagement with said firearm;

a cam follower mounted on said latch;

a link slidably mounted directly on said base;

a cam mounted on said link and engaging said cam follower;

a grip attached to said link;

a guide body mounted directly on said base in spaced relation to said link, said cam engaging said guide body upon motion of said latch for maintaining said cam engaged with said cam follower; wherein manual pulling of said grip moves said cam, said cam follower following said cam thereby moving said latch contact surface out of engagement with said firearm.

16. The charging handle according to claim 15, wherein said cam follower comprises a lobe extending from said latch.

17. The charging handle according to claim 16, wherein said pivot axis passes through said lobe.

18. The charging handle according to claim 15, wherein:

said link comprises a shaft having a first end engaged with said grip and a second end;

a pin extends from said shaft proximate said second end thereof, said cam being mounted on said pin.

19. The charging handle according to claim 15, wherein said grip comprises a first projection positioned on a first side of said link, and a second projection positioned on a second side of said link opposite to said first side.

20. The charging handle according to claim 19, wherein said grip is pivotably mounted on said link.

21. The charging handle according to claim 20, wherein said grip further comprises:

a first reaction surface positioned on said base;

a first pivot surface positioned on said first projection and facing said first reaction surface, said first pivot surface engaging said first reaction surface when said second projection is pulled to pivot said grip.

22. The charging handle according to claim 21, wherein at least one of said first pivot surface and said first reaction surface is curved.

23. The charging handle according to claim 21, wherein said grip further comprises:

a second reaction surface positioned on said base;

a second pivot surface positioned on said second projection and facing said second reaction surface, said second pivot surface engaging said second reaction surface when said first projection is pulled to pivot said grip.

24. The charging handle according to claim 23, wherein at least one of said second pivot surface and said second reaction surface is curved.

25. The charging handle according to claim 15, further comprising a rod having a first end attached to said base and a second end engageable with said bolt carrier.

26. A firearm comprising:

a bolt carrier;

a rod having a first end engageable with said bolt carrier and a second end;

a charging handle comprising:

a base attached to said second end of said rod;

a latch movably mounted on said base, said latch having a contact surface movable into and out of engagement with said firearm upon motion of said latch;

a cam follower mounted on said latch;

a link movably mounted directly on said base;

a cam mounted on said link and engaging said cam follower;

a grip attached to said link;

a guide body mounted directly on said base in spaced relation to said link, said cam engaging said guide body upon motion of said latch for maintaining said cam engaged with said cam follower; wherein manual pulling of said grip moves said cam, said cam follower following said cam thereby moving said latch contact surface out of engagement with said firearm.

27. The charging handle according to claim 26, wherein said latch is pivotably mounted on said base about a pivot axis.

28. The charging handle according to claim 27, wherein said cam follower comprises a lobe extending from said latch.

29. The charging handle according to claim 28, wherein said pivot axis passes through said lobe.

30. The charging handle according to claim 26, further comprising:

a plunger movably mounted on said base, said plunger engaging said latch;

a spring acting between said base and said plunger, said spring biasing said plunger toward said latch for biasing said latch contact surface into engagement with said firearm.

31. The charging handle according to claim 26, further comprising a spring acting between said base and said link for biasing said cam away from said cam follower.

32. The charging handle according to claim 26, wherein:

said link comprises a shaft having a first end engaged with said grip and a second end;

a pin extends from said shaft proximate said second end thereof, said cam being mounted on said pin.

33. The charging handle according to claim 26, wherein said grip comprises a first projection positioned on a first side of said link, and a second projection positioned on a second side of said link opposite to said first side.

34. The charging handle according to claim 33, wherein said grip is pivotably mounted on said link.

35. The charging handle according to claim 34, wherein said grip further comprises:

a first reaction surface positioned on said base;

a first pivot surface positioned on said first projection and facing said first reaction surface, said first pivot surface engaging said first reaction surface when said second projection is pulled to pivot said grip.

36. The charging handle according to claim 35, wherein at least one of said first pivot surface and said first reaction surface is curved.

37. The charging handle according to claim 35, wherein said grip further comprises:

a second reaction surface positioned on said base;

a second pivot surface positioned on said second projection and facing said second reaction surface, said second pivot surface engaging said second reaction surface when said first projection is pulled to pivot said grip.

38. The charging handle according to claim 37, wherein at least one of said second pivot surface and said second reaction surface is curved.

* * * * *